United States Patent [19]

Petruccelli

[11] 4,187,780

[45] Feb. 12, 1980

[54] DETONATING CORD AND BLASTING CAP CONNECTOR BLOCK

[75] Inventor: Guy S. Petruccelli, Simsbury, Conn.

[73] Assignee: Ensign-Bickford Company, Simsbury, Conn.

[21] Appl. No.: 904,393

[22] Filed: May 10, 1978

[51] Int. Cl.[2] ..... F42B 3/10

[52] U.S. Cl. ..... 102/28 R; 102/22 R; 102/27 R

[58] Field of Search ..... 102/22, 24, 27 R, 27 I, 102/28 R, 28 A, 29, 203

[56] References Cited

U.S. PATENT DOCUMENTS

| | | | |
|---|---|---|---|
| 3,570,402 | 3/1971 | Troon et al. | 102/28 R |
| 3,878,785 | 4/1975 | Lundborg | 102/22 R |
| 3,987,732 | 10/1976 | Spraggs et al. | 102/22 R |
| 3,987,733 | 10/1976 | Spraggs et al. | 102/22 R |

*Primary Examiner*—Verlin R. Pendegrass

*Attorney, Agent, or Firm*—Donald J. Hayes; R. William Reinsmith

[57] ABSTRACT

A connector block for mounting a blasting cap and detonating cord in intimate side-by-side association and having an elongated body with a longitudinally extending slot for receiving a signal transmitting shock tube and an elongated cavity for receiving the blasting cap above the shock tube, a knob chock on the forward end of the body for receiving a loop of the flexible tube and a pair of opposed upstanding cleat extensions for receiving a detonating cord and connecting a free end of the detonating cord to the connector block.

9 Claims, 5 Drawing Figures

DETONATING CORD AND BLASTING CAP CONNECTOR BLOCK

BRIEF SUMMARY OF THE INVENTION

The present invention relates generally to surface connectors for explosive blasting operations and is more particularly concerned with a new and improved detonating cord and blasting cap connector block useful for example in surface connector systems of the type disclosed in U.S. Pat. No. 3,987,733 of Richard W. Spraggs, dated October 26, 1976, and entitled "Millisecond Delay Surface Connector."

It is a primary object of the present invention to provide a new and improved detonating cord and blasting cap connector block for readily connecting a detonating cord and blasting cap without the use of tools, tape, or a difficult tying procedure.

It is another object of the present invention to provide a new and improved detonating cord and blasting cap connector block which facilitates interconnecting surface trunklines and connecting a trunkline to and disconnecting it from a downline without destroying either line.

It is a further object of the present invention to provide a new and improved connector block of the type described which permits bi-directional detonation from either a surface trunkline to a downline or from the downline to the surface trunkline.

It is another object of the present invention to provide a new and improved connector block of the type described which provides for quickly and securely attaching a shock tube trunkline and blasting cap to a downline.

It is a further object of the present invention to provide a new and improved connector block of the type described which may be economically manufactured yet is sufficiently durable to effectively confine shrapnel from the blasting cap mounted therein.

It is another object of the present invention to provide a new and improved connector block of the type described which provides for securely packaging a blasting cap for storage and transportation and which prevents sympathetic detonation of other closely packaged blasting caps when one blasting cap is detonated inadvertently due, for example, to fire or impact.

Other objects will be in part obvious and in part pointed out more in detail hereinafter.

A better understanding of the invention will be obtained from the following detailed description and the accompanying drawing of an illustrative application of the invention.

DESCRIPTION OF THE PREFERRED EMBODIMENT

Figures 1, 2, 3, 4, 5:
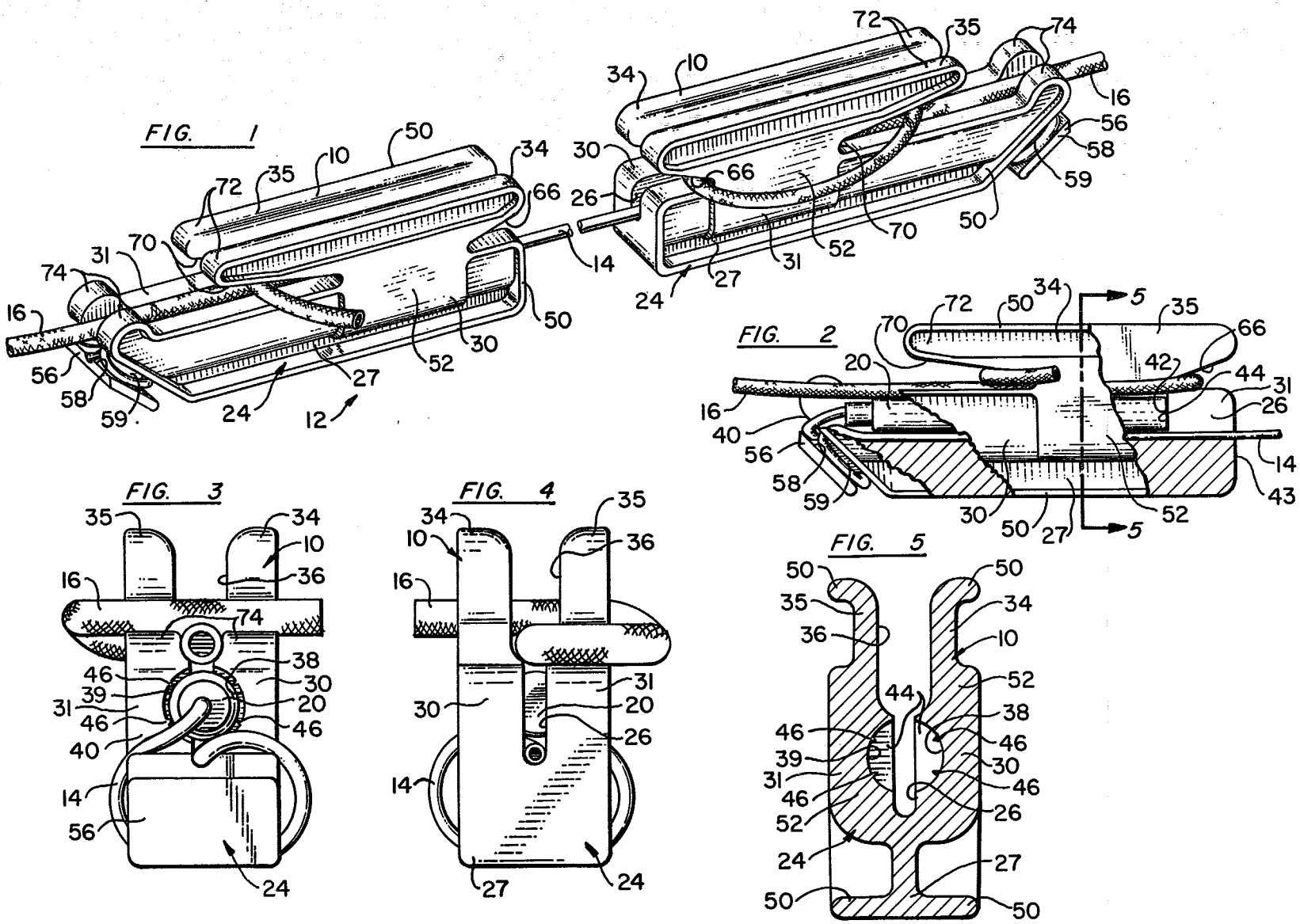
FIG. 1 is a perspective view, partly broken away, of a surface connector system employing an embodiment of a detonating cord and blasting cap connector block of the present invention.
FIG. 2 is a side view, partly broken away and partly in section, of a connector block assembly of the surface connector system.
FIGS. 3 and 4 are enlarged front and rear end views respectively of the connector block assembly.
FIG. 5 is an enlarged transverse section view of the connector block taken substantially along line 5—5 of FIG. 2.

Referring now to the drawing in greater detail wherein like reference numerals indicate like parts throughout the figures, an embodiment 10 of a detonating cord and blasting cap connector block of the present invention is shown employed in a surface connector system 12 of the type disclosed in aforementioned U.S. Pat. No. 3,987,733. More particularly, the delay connector system 12 is shown comprising a pair of spaced connector blocks 10, an interconnecting signal transmitting shock tube 14, a pair of elongated, generally cylindrical signal amplifying or blasting caps 20 at the ends of the signal transmitting tube 14, and a pair of trunkline detonating cords 16.

The detonating cord or fuse 16 may, for example, be the type sold by Ensign-Bickford Company of Connecticut under the name "Primacord". The signal transmitting tube 14 and the blasting caps 20, which may be signal delay caps, may, for example, be the type described in U.S. Pat. No. 3,987,733. Also, the utility and advantages of such a surface connector system is described in U.S. Pat. No. 3,987,733 and therefore will not be further described here. The present invention is directed to the provision of a new and improved detonating cord and blasting cap connector block 10 useful, for example, in such a surface connector system and similar systems where it is desired to provide side initiation, for example, between a detonating cord and blasting cap.

The detonating cord and blasting cap connector block 10 is manufactured as a single piece of molded plastic of a suitable durable material such as high density polyethylene and having sufficient flexure for installing the blasting cap 20 and detonating cord 16 and yet having sufficient rigidity for securely retaining the detonating cord and blasting cap.

The connector block 10 which is shown is symmetrical about a longitudinally extending plane. An elongated lower body portion 24 of the block 10 has a lower central slot 26 extending longitudinally the full length of the block 10 and a pair of opposed substantially identical sides 30, 31 on opposite sides of the slot 26 extending upwardly from a base 27. A pair of opposed substantially identical anvil-shaped cleat-like extensions 34, 35 extend upwardly from the sides 30, 31 respectively to form an upper longitudinally extending central slot 36 somewhat wider than the lower slot 26 and which provides for receiving a detonating cord 16 therebetween.

The sides 30, 31 are formed with inner opposed, partially cylindrical recesses or cavities 38, 39 extending longitudinally from a front end 40 of the connector block body 24 to a rear terminal end 42 short of the rear end 43 of the body 24. The opposed cavities 38, 39 together with the intermediate lower slot 26 form an elongated blasting cap cavity for manually inserting a blasting cap 20 from the front end 40 of the connector block body 24 into the blasting cap cavity and into engagement with transverse coplanar abutments 44 at the rear terminal end 42 of the cavity. Longitudinally extending integral ribs 46 facilitate inserting and retaining the blasting cap 20 in the cavity.

The body 24 of the connector block 10 has relatively thin side walls along the base 27, sides 30, 31 and cleat-like extensions 34, 35 and a peripheral laterally outwardly projecting rim 50 is provided around the perimeter of each side and respective cleat-like side extension of the connector block 10. In addition, relatively thick wall sections 52 are provided at the juncture of each side 30, 31 and respective cleat-like extension 34, 35 which extend forwardly from the terminal end 42 of the blasting cap cavity to encase the rear explosive end of the blasting cap 20.

The lower central slot 26 extends above and below the blasting cap cavity and has a width for snuggly receiving the flexible signal transmitting tube 14 immediately below the blasting cap 20. Also, a generally square downwardly and forwardly projecting knob chock 56 is provided on the front downwardly inclined end 40 of the connector block body 24 for wrapping the flexible signal transmitting tube 14 thereabout for assisting in retaining the tube 14 and attached blasting cap 20 in the shown desired assembly with the connector block 10. The knob chock 56 has an outer peripheral flange 58 with upper projections on opposite sides of the central slot 26 to provide a groove 59 for retaining the flexible signal transmitting tube 14 around the knob chock 56. The groove 59 and bottom of the slot 26 are rounded to provide for snuggly receiving the signal transmitting tube 14. Accordingly, the signal transmitting tube 14 and attached blasting cap 20 are mounted on the connector block 10 by initially placing the signal transmitting tube 14 at the bottom of the slot 26, inserting the rear end of the blasting cap 20 into the blasting cap cavity and into engagement with the rear end abutments 44, placing a loop of the flexible tube 14 about the knob chock 56 and then pulling the tube 14 at the rear end of the connector block 10 to tighten the tube loop about the knob chock 56.

After the flexible tube 14 and blasting cap 20 are installed as described, a detonating cord 16 may be readily connected to the connector block by first placing the detonating cord 16 into the lower end of the upper slot 36 formed between the cleat extension 34, 35 and along the upper edge of the lower narrow slot 26. The rear free end of the detonating cord 16 is then wrapped around the pair of opposed cleats 34, 35 as shown. The rear end of the detonating cord 16 is thereby retained within one of the rear generally V-shaped grooves 66 formed between opposing rim portions of the rear ends of the cleat extensions 34, 35 and the respective sides 30, 31. Somewhat similarly, the detonating cord 16 is also retained within both of the forward generally V-shaped grooves 70 formed between opposing rim portions of the forward horn ends 72 of the cleats 34, 35 and the respective sides 30, 31. The free end of the detonating cord 16 is thereby wedged between the forward ends of the cleats 34, 35 and an underlying longitudinally extending section of the cord 16 to hold that section firmly against the elongated body portion 24. Also, the sides 30, 31 of the connector block body 24 are formed with a pair of opposed upstanding projections 74 at the upper forward end of the body 24 for receiving and wedging the detonating cord 16 therebetween. Accordingly, the detonating cord 16 is mounted in intimate side-by-side parallel association with the blasting cap 20 (but slightly spaced from the blasting cap 20 in the shown embodiment) along the full length of the blasting cap 20. The intimate side-by-side association provides for side initiation of either the blasting cap 20 or the detonating cord 16 by the other.

It can be seen that the connector block 10 provides for fully enclosing and protecting the blasting cap 20 during storage and transportation, etc. Also, the opposed relatively thick sections 52 of the connector block 10 and abutments 44 provide for encasing the rear explosive end of the blasting cap 20 to define shrapnel and prevent sympathetic detonation of one blasting cap 20 by another cap 20 where the blasting caps 20 are packaged closely together in a single package.

The connector block 10 of the present invention therefore provides for securely encasing and retaining a blasting cap and for readily connecting a detonating cord to the blasting cap at the time of use. Also, the connections of both the signal transmitting tube 14 and detonating cord 16 are made without the use of tools, tape, or a difficult tying procedure and, for example, so that trunkline connections and disconnections can be readily made to downlines without destroying either line.

As will be apparent to persons skilled in the art, various modifications, adaptations, and variations of the foregoing specific disclosure can be made without departing from the teachings of the present invention.

I claim:

1. An elongated connector block for mounting an elongated blasting cap and a detonating cord in side-by-side association for intimately connecting them for side initiation, comprising a longitudinally extending body of generally U-shaped transverse cross section having an intermediate longitudinally extending slot the full length thereof and a pair of opposed sides on opposite sides of the slot contoured to provide an enlarged elongated blasting cap cavity extending longitudinally from a front end of the body along at least a portion of said slot for longitudinally inserting and receiving an elongated blasting cap therein from the front end of the body, and an upward integral extension of at least one side of the body forming a pinch-cleat for longitudinally positioning a flexible detonating cord along the slot in intimate parallel side-by-side association with and above a blasting cap inserted in said cavity and for retaining the detonating cord in said position by winding it about the pinch-cleat extension.

2. A connector block according to claim 1 wherein the connector block has a knob chock at the front end of the body for receiving a loop of flexible signal transmitting fuse connected to the blasting cap, wherein the longitudinally extending slot extends below the blasting cap cavity for receiving the flexible fuse, and wherein the sides of the body have aligned top edges and the pinch-cleat extension has a front horn portion overlying the top edge of its respective side to define a forwardly flaring detonating cord retaining slot.

3. A connector block according to claim 1 wherein the sides of the body have generally flat aligned longitudinally extending top edges and said pinch-cleat extension is anvil shaped with a front detonating cord retaining horn portion cooperating with the top edge of its respective side for wedging the detonating cord therebetween.

4. A connector block according to claim 1 wherein the longitudinally extending slot extends sufficiently below the blasting cap cavity to receive a flexible signal transmission fuse connected to the blasting cap, wherein the connector block comprises a knob chock at the front end of the body for receiving a loop of the flexible fuse for assisting in preventing inadvertent withdrawal of the cap from the blasting cap cavity.

5. A connector block according to claim 4 wherein the knob chock has a peripheral groove for receiving the loop of flexible fuse.

6. A connector block according to claim 1 wherein the sides of the body have opposed respective pinch-cleat extensions spaced apart for placing a detonating cord therebetween into said side-by-side association with a blasting cap inserted in the blasting cap cavity.

7. A connector block according to claim 1 wherein the sides of the body have a pair of opposed respective projections at the front end of the body forming a slot for wedging the detonating cord therebetween for retaining the detonating cord in side-by-side association with a blasting cap inserted in the blasting cap cavity.

8. A connector block according to claim 1 wherein the blasting cap cavity extends from the front end of the body to a rear terminal end adjacent said pinch-cleat extension, and wherein the sides have relatively thicker sections adjacent the rear terminal end of said blasting cap cavity for securely encasing the rear end of an inserted blasting cap.

9. A connector block according to claim 1 wherein the longitudinally extending slot extends sufficiently below said blasting cap cavity to receive a flexible signal transmission fuse connected to said blasting cap, wherein the connector block further comprises a knob chock at the front end of the body having a peripheral groove for receiving a loop portion of said flexible fuse, wherein both sides of the body have opposed respective front end projections providing for mounting the detonating cord therebetween and opposed upwardly extending anvil shaped pinch-cleat extensions forming a slot therebetween having a width greater than the width of the longitudinally extending slot in the body for placing a detonating cord therebetween into said side-by-side association with a blasting cap in the blasting cap cavity, each of the pinch-cleat extensions having a retaining portion cooperating with its respective side for wedge retention of a free end of the detonating cord therebetween.

* * * * *